US005356026A

United States Patent [19]

Andress et al.

[11] Patent Number: 5,356,026

[45] Date of Patent: Oct. 18, 1994

[54] DOUBLE SEAL CONTAINER

[75] Inventors: Bradley W. Andress, Hudson, Wis.; Dale V. Rude, St. Paul, Minn.; Dick E. VanKeuren, River Falls, Wis.

[73] Assignee: Plastics, Inc., St. Paul, Minn.

[21] Appl. No.: 34,902

[22] Filed: Mar. 22, 1993

[51] Int. Cl.[5] ..... B65D 43/04

[52] U.S. Cl. ..... 220/306; 220/307; 220/339

[58] Field of Search ..... 220/306, 307, 339, 343, 220/342, 337

[56] References Cited

U.S. PATENT DOCUMENTS

| | | | |
|---|---|---|---|
| 3,957,097 | 5/1976 | Swett . | |
| 4,079,857 | 3/1978 | Crisci | 220/306 |
| 4,170,315 | 10/1979 | Dubach et al. | 220/339 |
| 4,202,464 | 5/1980 | Mohs et al. | 220/339 |
| 4,209,107 | 6/1980 | Crisci | 220/306 |
| 4,293,080 | 10/1981 | Letica | 220/306 |
| 4,349,119 | 9/1982 | Letica | 220/306 |
| 4,387,828 | 6/1983 | Yates | 220/284 |

FOREIGN PATENT DOCUMENTS 866652 4/1961 United Kingdom .

*Primary Examiner*—Joseph Man-Fu Moy
*Attorney, Agent, or Firm*—Baker & McKenzie

[57] ABSTRACT

A container assembly having a lid and a container in which a double seal is formed between the lid and the container, one seal being formed on the upper edge of the container rim and the second seal on the upper internal wall of the container, said seals being mechanically locked to one another in an operative condition wherein, in addition, said assembly is stackable, some size nestable, different size nestable with lids off and different size nestable with lids on.

17 Claims, 8 Drawing Sheets

14
13
15
10
11
20
19
17
9
29
35
34
37
9
33
36
12
24
26
25

48
13
14
11
15
16
47
49
20
19
17
10
18
28
30
29
31
12
24
27
26
25

Fig. 10.
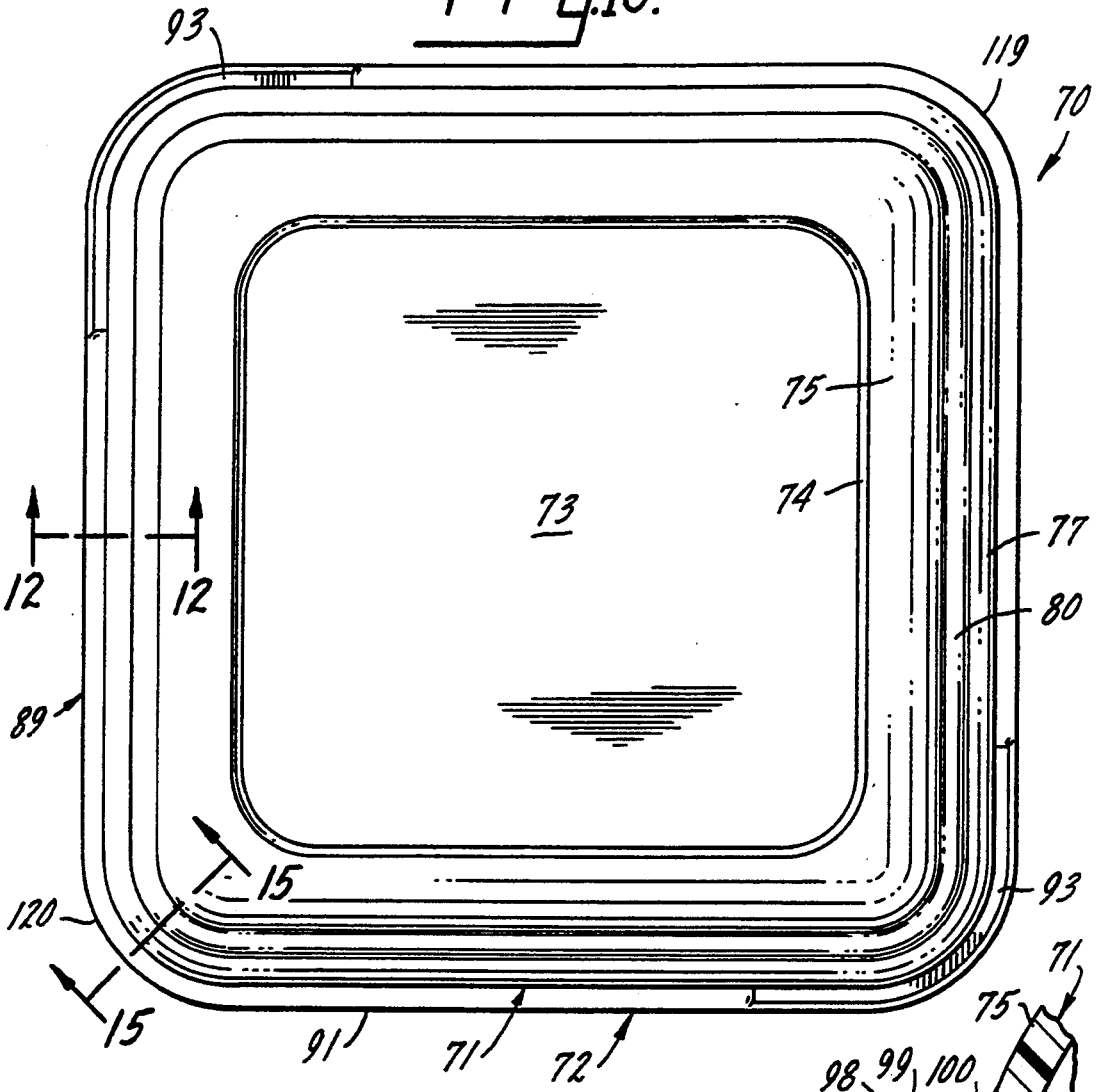
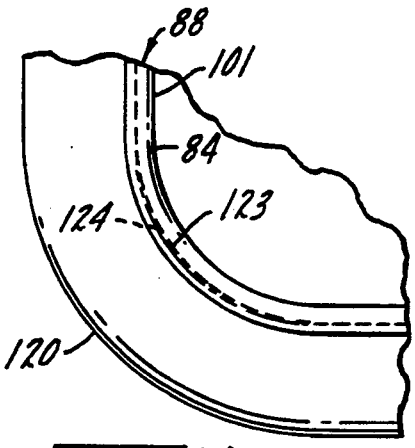
Fig. 11.
Fig. 12.
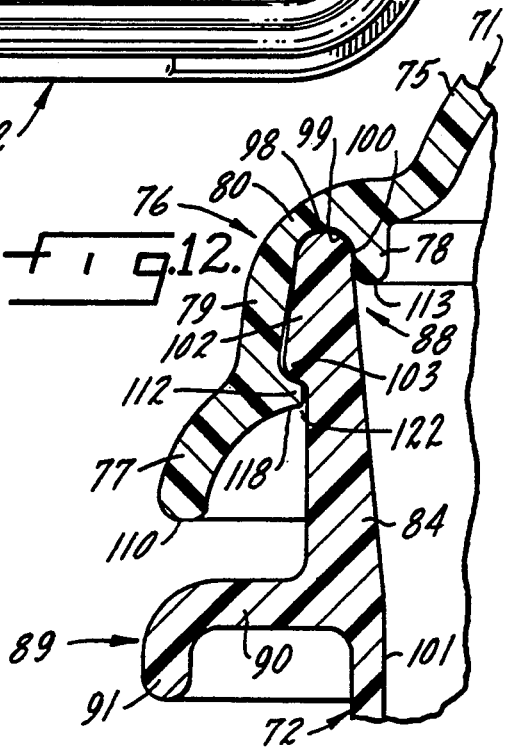

DOUBLE SEAL CONTAINER

This invention relates to container assemblies of the type consisting of a lid and a container, and particularly to such containers which are especially adapted for use by ordinary consumers in the storing of food in refrigerators. More specifically the invention pertains to such container assemblies having a double seal for added comestible preservation quality.

BACKGROUND OF THE INVENTION

Container assemblies consisting of a lid and a container for storing foods under refrigeration by the ordinary consumer are well known of which U.S. Pat. No. 4,471,880 is a typical example. Desirable features in such container assemblies include (a) good sealing integrity at the lid-container junction, (b) the creation of an audible sound at the conclusion of the assembly of the lid to the container so as to inform the user that the container assembly has been properly assembled and thus is in a condition to ensure maximum preservation of the comestible contents, (c) easy assembly of the lid and container, (d) easy disassembly of the lid from the container in both round and, particularly, rectangular container configurations, (e) stable stacking of same size container assemblies one on the other, (f) nesting of same size containers one within another, (g) nesting of a first, and successive if desired, container assemblies, including lids, within a larger container assembly and (h) a gently contoured, pleasing to the eye configuration.

Although a well constructed container assembly having only a single peripheral seal may give acceptable results much of the time, a double seal is highly advantageous since the failure of both seals, and consequent accelerated spoilage of the comestible contents, is highly unlikely. From a probability standpoint, if the failure of a single seal system occurs once in a hundred instances, the total failure of a double seal system would occur only once in ten thousand instances, and possibly even less.

An audible sound, preferably a short click like noise, is desirable when assembling a lid to a container to give the consumer notice that a seal has been made; the consumer, through experience, learns to associate an audible click with a properly assembled container assembly. By the same token, the absence of an audible noise alerts the consumer to the fact that further effort must be made to properly seal the container assembly.

Easy assembly of the lid and the container is also important to consumer acceptance of such container assemblies. Multi-step assembly procedures, or out of the ordinary manipulation of parts, are to be avoided since such steps are not well accepted by ordinary consumers. Most preferably, assembly should be the result of simply placing a lid on a container and pressing, by reasonable hand pressure, once or at most a few times on the lid or about its periphery until the above described audible click is heard. In essence, putting a lid on a refrigerator container should be no more complicated, and should not require any additional mental or physical effort on the part of the consumer, then the assembling of a lid to a container within other container assemblies in the consumer's experience such as large coffee cans, etc.

Easy disassembly is equally important since a container assembly which cannot be easily disassembled becomes a source of irritation and frustration to the consumer and thus may be laid aside as requiring too much effort for today's convenience oriented living styles. A container assembly which is difficult to disassemble also has the potential for spilling the contents thereof as will happen when the consumer tilts such an assembly from the horizontal to obtain more opening leverage, particularly when the container assembly contains liquids, such as soup. Disassembly is especially important in rectangular containers, both square and non-square. The consumer invariably opens a rectangular container from the corner and, in view of the flexibility of the material from which the container assembly is made and the consequent (i) flexing of the lid with respect to the container and (ii) increased tightening of interacting contacting parts on the lid in the container, particularly at the corner areas, a tendency for the lid to grip the container occurs. This gripping makes disassembly a more difficult task with rectangular containers than with round containers.

It is also desirable that such containers be stackable when in use since the height of such containers is generally less than one and a half times the vertical distance between two or more shelves in the refrigerator, and hence refrigerator shelf space is conserved.

Nesting of same size containers is particularly advantageous in utilizing storage areas in locations, such as kitchen cabinets, where such containers are placed when not in use.

Since such containers are frequently sold in sets which may range in size from as little as one half cup up to about three quarts, storage space is also of concern even if the consumer possesses only one container of each capacity. Hence, it is highly desirable that each container in a set of containers, along with its lid, be nestable within the next larger capacity container.

And finally, such container assemblies should, in addition to having all the above described physical and mechanical properties, also have aesthetically pleasing appearance to the eye so that they are readily accepted by the consumer and become items of common place, everyday use. U.S. Pat. No. 4,471,880, though it is said to include an audible click, be easy to assemble and have the capacity to stack in a lid-on condition, totally lacks the feature of double seal which virtually guarantees no spoilage of the contents.

SUMMARY OF THE INVENTION

The invention comprises container assemblies which, in individual form, possess all of the above described individual features and which, in set form, possess all of the above described set form features. Thus, an individual container assembly, consisting of a lid and a container, has a double peripheral seal when the lid and container are secured to one another, create an audible sound upon assembly, and specifically, a click when they are assembled one to the other, are easy to assemble and disassemble and, in multiples of the same size, nest easily one within another. In plural form, the container assemblies are stackable in a very efficient matter and nest one within another in set form, each container assembly, including its lid, nesting within the next largest size container throughout the entire set. All container assemblies of every size are aesthetically pleasing to the eye and are made of conventional economically priced material so that the invention is within the economic reach of the great bulk of consumers.

BRIEF DESCRIPTION OF THE DRAWING

The invention is illustrated more or less diagrammatically in the accompanying drawing in which:

FIG. 10 is a top plan view of the unique double seal container assembly of the present invention as embodied in a rectangular container;

FIG. 11 is a partial top plan view of the corner construction of the rectangular container of the present invention;

FIG. 12 is a view taken substantially along the line 12—12 of FIG. 10;

DESCRIPTION OF A SPECIFIC EMBODIMENT

Figure 1:
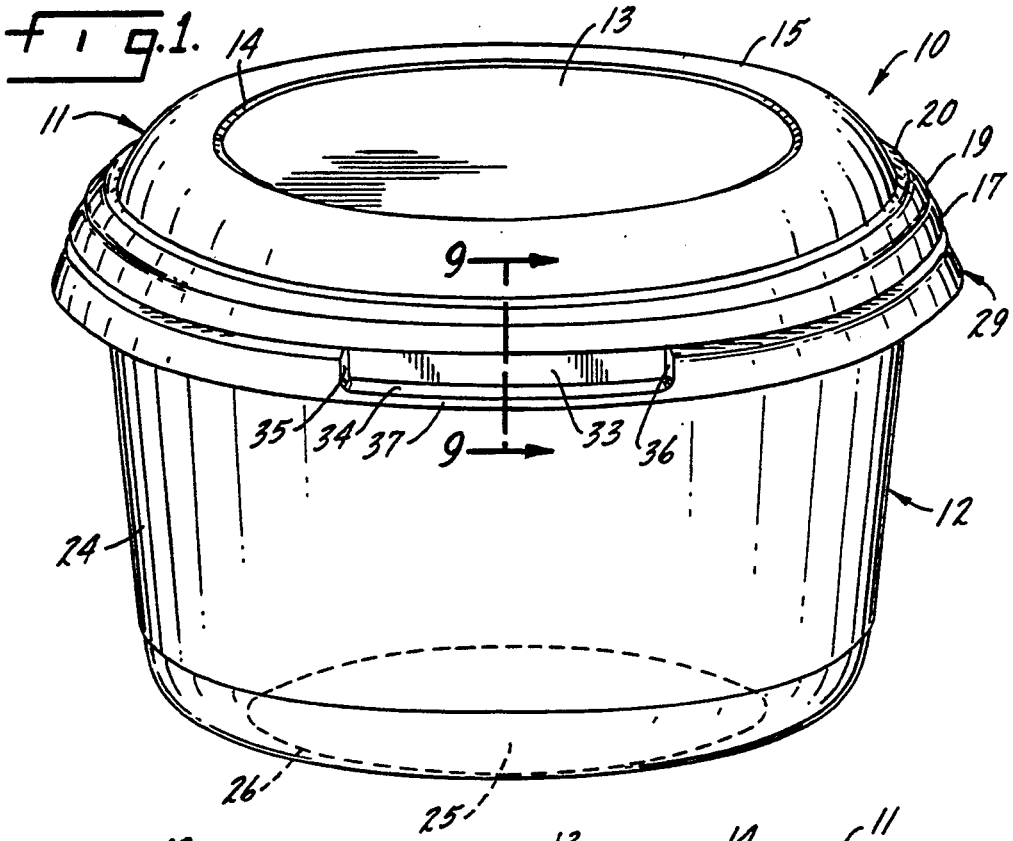
FIG. 1 is a perspective of the unique double seal container assembly of the present invention as embodied in a round container.

Like reference numerals will be used to refer to like or similar parts from Figure to Figure in the following description of the drawing.

Figure 2:
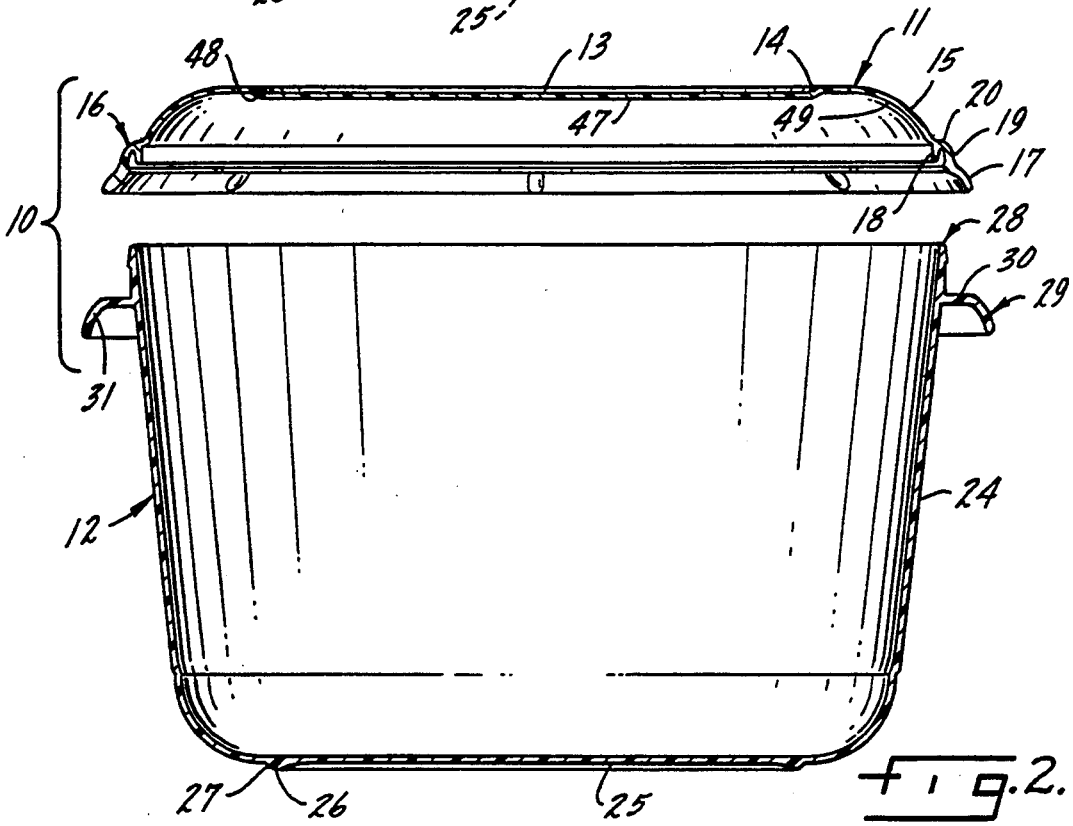
FIG. 2 is an exploded section view of the round container assembly of FIG. 1.

The unique container assembly of this invention is indicated generally at 10 in FIGS. 1 and 2. The assembly includes a lid, indicated generally at 11, and a container, indicated generally at 12. Lid 11 has a central depression, indicated at 13, which is bounded by an upwardly and outwardly inclined rim 14 which in turn melds into a circular crown portion 15. The lower radially outermost portion of the crown melds into a flange area, indicated generally at 16, see also FIGS. 5 and 6, which in turn melds into a circular, outwardly and downwardly curved lip 17. An inner lid flange is indicated at 18, an outer lid flange at 19, and a hinge area at 20, the hinge area in effect connecting the inner and outer flanges 18 and 19.

The container 12 includes an upwardly and slightly outwardly inclined circular side wall 24 which melds into bottom wall 25. A circular ridge 26 is formed on the outside bottom surface of bottom wall 25. The ridge has an outer, upwardly inclined surface 27 which preferably matches the slope of the rim 14 in the lid 11. The diameter of the ridge 26 is no greater than, and most preferably equal to, the diameter of the central depression 13 of the lid so that two container assemblies of the size illustrated in FIGS. 1 and 2 when in use may be stacked one upon the other in a very stable condition, see FIG. 16.

The upper end of sidewall 24 terminates in a rim indicated generally at 28 which will be described in detail hereafter. A lifting flange is indicated generally at 29 for grasping and lifting the container assembly, or just the container. The flange 29 includes an upper generally horizontally oriented portion 30 which terminates at its outer periphery in a down turned portion 31, see also FIGS. 7 and 8. From FIGS. 1 and 9 it will be seen that the lifting flange 29 has one or two, at least, downwardly stepped portions 33, each of which includes a base portion 34. The vertically open space between the bottom of lip 17 of the lid and the base portion 34 of the lifting flange 29 forms an opening into which the fingertips of a user may be inserted to disassemble the lid 11 from the container 12 when they are in the assembled condition of FIG. 1. Base portion 34 is defined by end vertical wall portions 35, 36 which are spaced any desired distance apart, such as about three inches which is ample to enable a user to insert three or four fingertips.

Figures 7, 8, 9:
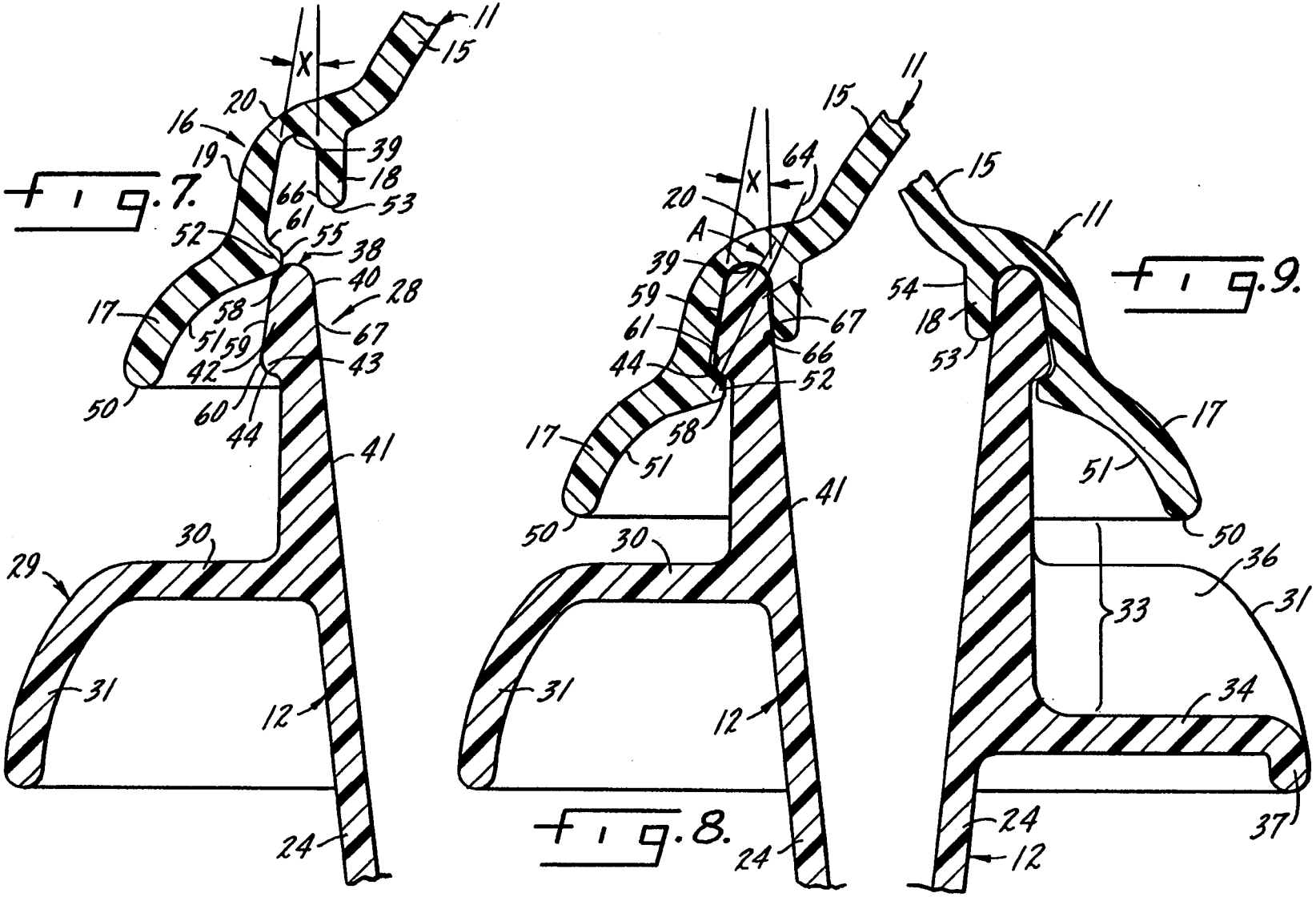
FIG. 7 is a diagrammatic view of the relative positions of the lid and the container at the initiation of contact there between during assembly.
FIG. 8 is a diagrammatic view of the lid and container in a fully assembled and sealed condition.
FIG. 9 is a view taken substantially along the line 9—9 of FIG. 1 illustrating particularly the finger grip means for disassembling the container assembly.

The container rim 28 at the upper end of the sidewall 24 is specially contoured so as to cooperate with the lid to effect a double seal utilizing a mechanical locking action. The upper edge, indicated generally at 38 as best seen in FIG. 7, is rounded for the purpose of closely conforming to the bight 39 formed between the inner flange 18 and outer flange 19 beneath the hinge area 20 of the lid 11. However, the lower portion of the approximate inner half of the rounded upper edge 38 projects radially inwardly as at 40 beyond the interior surface 41 of sidewall 24 thereby creating, in effect, a slight internal bulge at the upper end of sidewall 24. The upper end portion of the rim 28 is thickened as contrasted to the thickness of wall 24 beneath the flange 29, and increases in horizontal thickness for a short distance downwardly from the upper edge as indicated at 42, said thickness terminating in a lower shoulder 43 having a downwardly facing bearing surface 44.

Referring now to FIGS. 3–6, the features for, firstly, ensuring alignment of the lid 11 with a container 12 preparatory to sealing and, secondly, generating an audible sound upon assembly to signal proper assembly of the lid to the container are there shown.

Figure 3:
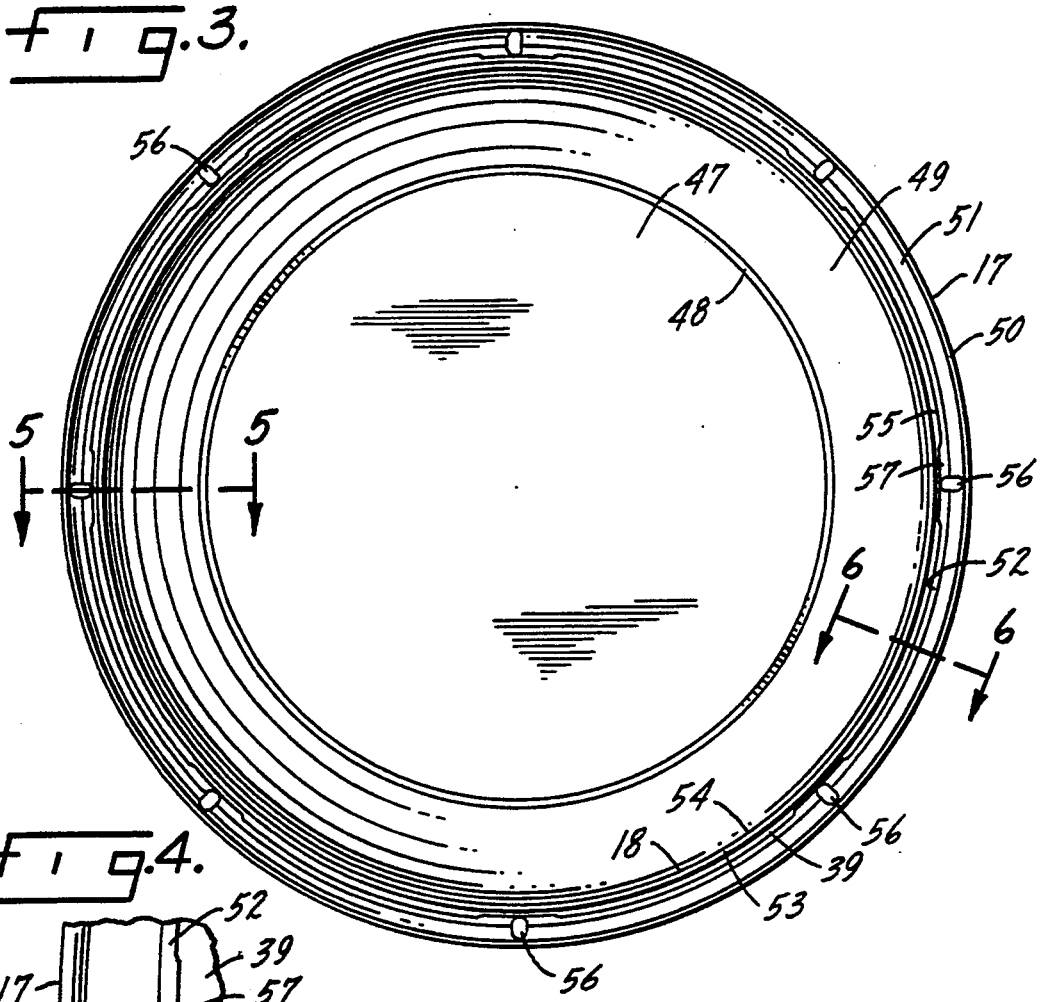
FIG. 3 is a plan view of the underside of the lid of the container assembly of FIGS. 1 and 2.

In FIG. 3 the under surface of the central depression 13 is indicated at 47, the underside of rim 14 at 48 and the underside of crown 15 at 49. The bottom edge of lip 17 is indicated at 50, see also FIGS. 8 and 9, the under side of lip 17 at 51, see also FIGS. 8 and 9, and a snap ring which projects generally radially inwardly from the lower end of the outer lid flange 19 at 52. The bottom edge of flange 18 is indicated at 53 and an internal shoulder at 54.

Figure 4:
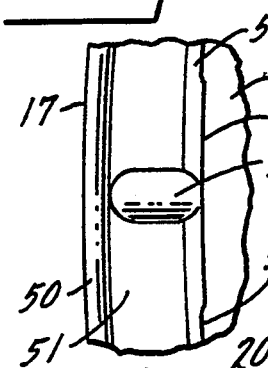
FIG. 4 is a detail view of the alignment and snap-on feature portion of the underside of the lid of FIG. 4 to an enlarged scale.
Figure 5:
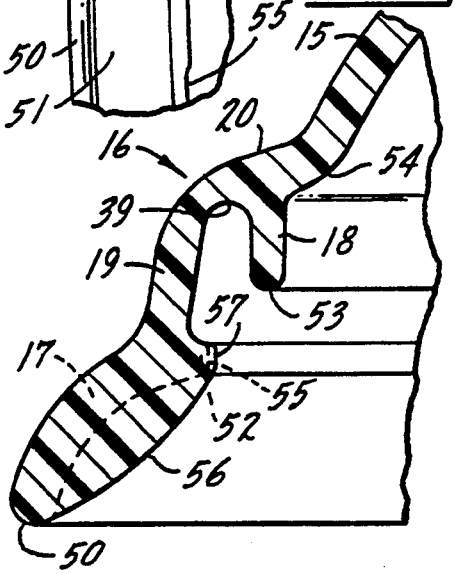
FIG. 5 is a section view taken substantially along the line 5—5 of FIG. 3 to an enlarged scale.
Figure 6:
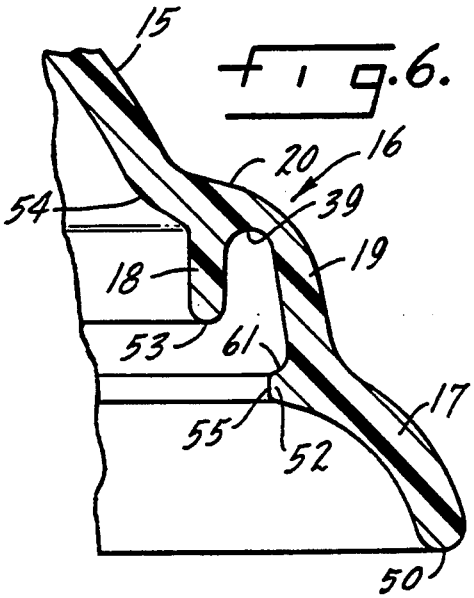
FIG. 6 is a section view taken substantially along the line 6—6 of FIG. 3 to an enlarged scale.

A plurality, in this instance eight, generally elliptically shaped alignment cams are indicated at 56, see particularly FIGS. 4 and 5. Each cam extends from the radially inner side of the bottom edge 50 of lip 17 to a point slightly radially inwardly from the inner edge 55 of the snap ring 52, all as best seen in FIGS. 4 and 5. A thickened area of the snap ring 52 is indicated at 57 associated with each cam 56, see particularly FIGS. 4 and 5.

FIG. 7, 8 and 9, and particularly FIGS. 7 and 8, illustrate the sealing and locking features of the container assembly.

Referring first to FIG. 7 the lid 11 and container 12 are shown in their relative positions at the moment the lid contacts the container at the beginning of the assembly of the lid to the container. As there shown, the underside 58 of snap ring 52 contacts the left side of the upper edge of container rim 38. It will be noted that in this momentary position the lid 11 is undeformed and hence no part of it is stressed. Also, at this moment, a projection of the inner surface of outer flange 19 and a projection of the outer surface of flange 18 will form an angle X of approximately four degrees, though the exact angle will of course vary somewhat from system to system.

As the lid 11 is pushed downwardly in a seating and sealing direction, the cams 56 will enable snap ring 52 to slide over the upper edge 38 of the container rim 28, and the snap ring will slide downwardly along the outwardly flaring surface 59 of container rim 28. The further the downward movement of the lid progresses relative to the stationary container 12, the greater will be the outward displacement of the flange 19 from its illustrated FIG. 7 position. This outward displacement of flange 19 is possible because the material from which the lid is made has a natural resiliency in the as-manufactured condition, such as polypropylene. In addition, the flexing of flange 19 is assisted by the fact that the hinge area 20 has a lesser thickness than the thickness of flange 19 below it, or of crown 15 above it. During the movement of lid 11 onto container 12 the maximum deflection of the two lid flanges 18 and 19 away from one another will occur. The maximum flexure of hinge area 20 will occur when the inner edge 55, see FIG. 5, of snap ring 52 is aligned with the portion of container rim 28 which extends furthest radially outwardly. This will occur when snap ring 52 reaches point 60 on rim 28. At this position, a projection of the inside of flange 19 and a projection of the outside of flange 18 will form an angle substantially larger than angle X, and specifically on the order of about six degrees.

As lid 11 and snap ring 52 continue downward travel relative to container 12, the snap ring 52 will move inwardly as soon as shoulder 43 is cleared, and the upper side 61 of snap ring 52 will come to rest bearing against the shoulder surface 44, all as best shown in FIG. 8.

It will also be appreciated that, after an initial period of travel in which only snap ring 52 is in contact with the surface 59, the lower edge of inner flange 18 will contact the upper inner edge of container rim 38. As the lid continues to move downwardly, the bulged inner half 40 of upper edge 38 will deflect flange 18 radially inwardly.

When the lid comes to rest on the container as shown in FIG. 8 the bulged area 40 will make peripheral sealing contact with the right side of the bight portion 39 of the lid 11. The parts are so contoured that, although snap ring 52 is beneath shoulder 43, the fit between snap ring 52 and shoulder 43 is tight with the result that lid 11 is, in effect, pulled into contact with the inner portion of the upper edge 38 along a line of force indicated approximately at 64, the force being derived from the resistance to flexing of the material in the hinge area 20. As a result, in effect, a mechanical locking force is generated tending to draw the upper edge 38, including the bulged area 40, into tight sealing engagement with the inner portion of the bight 39 formed between the lid flanges 18 and 19. The resultant seating engagement forms the first, and primary, peripheral band seal between the lid and the container.

Due to the usual slight surface variations found in this type of mass produced plastic article and the possible lack of a complete seating of the lid 11 on container 12 by the consumer user, only intermittent line contact will be formed between the shoulder 43 and the snap ring 52, and hence, no seal will be formed, but this is acceptable since the essential purpose of the shoulder and snap ring arrangement is to ensure that sufficient contact is made between the top side of snap ring 52 and the underside of shoulder 43 to ensure that a tension force acting substantially along line 64 is created around the periphery of the assembly which causes a substantial portion of the bight 39 of lid 11 to contact upper edge 38, including bulged area 40, in sealing engagement as indicated at angle A in FIG. 8. Said angle A may be somewhat greater or lesser from peripheral point to peripheral point about the container than that shown in FIG. 8, but in any event a continuous band, which may vary slightly in width from location to location, of sealing contact, will be made between the lid and the container, this band forming the primary seal between the lid and the container.

A second peripheral seal will be formed between the lower outside surface 66 of the inner flange 18 and an area indicated approximately at 67 on the inside of the container wall near the upper edge thereof. The lower end of flange 18, after passing bulge 40, will, because of the tension derived as before described from the configuration of the parts, continually tend to move in a radially outward direction in an effort to return to its initial, as manufactured, condition shown in FIG. 7. Thus, a second seal band is formed between the lid and the container on the inside wall of the container. Though, the width of the seal band will not be as wide as the seal indicated at A, it will have at all times a substantial width so that a continuous peripheral seal is maintained despite the presence of the normal variations in the parts attributable to the materials used, the molding process, or other causes. Thus, a double seal will be formed between the interior of the container assembly and ambient atmosphere.

A rectangular container assembly, in this instance a square container, is indicated generally at 70 in FIG. 10. Container assembly 70 includes a lid, indicated generally at 71, and a container, indicated generally at 72. Lid 71 includes a central depression 73, an upwardly and outwardly inclined rim surface 74 surrounding and defining the central depression 73, and a crown portion 75. The lower radially outermost portion of the crown melds into a flange area indicated generally at 76, see particularly FIGS. 12 and 15, which in turn melds into a rectangular, outwardly and downwardly curved lip 77. An inner lid flange is indicated at 78, an outer lid flange at 79, and a hinge area at 80, the hinge area 80 in effect connecting the inner and outer flanges 78 and 79.

Figure 15:
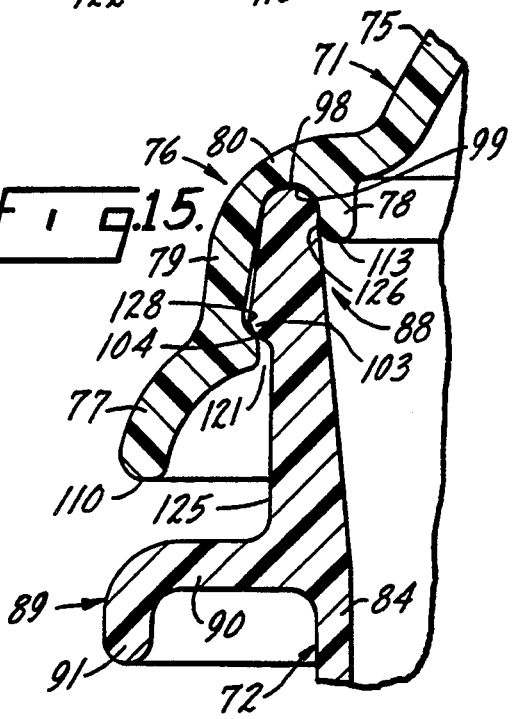
FIG. 15 is a view taken substantially along the line 15—15 of FIG. 10.

The container includes an upwardly and slightly outwardly inclined side wall 84, see particularly FIGS. 12 and 15, which melds into a bottom wall, not shown. A generally rectangularly contoured ridge, not shown, is formed on the outside bottom surface of the bottom wall. Said ridge will have an outer upwardly and inwardly inclined surface similar to surface 27 in the embodiment of FIGS. 1–9, which preferably matches the slope of the rim 74 in the lid 71. A stable stacking of two like size containers is thereby provided. The dimensions of the ridge are no greater than, and most preferably equal to, the dimensions of the central depression 73 of the lid so that the container assemblies of the size illustrated in FIGS. 10 and 13, when in use, may be stacked one upon the other in a very stable condition. The upper end of the side wall 84 terminates in a rim indicated generally at 88.

A lifting flange is indicated generally at 89, see FIGS. 12 and 15, for gripping and lifting the container assembly, or just the container, as required. The flange 89 includes an upper generally horizontally oriented portion 90 which terminates at its outer portion in downturned lip 91. From FIG. 10 it will be seen that the lifting flange 89 has two downwardly stepped portions 93 located at diagonally opposite corners of the container assembly, each of which is similar in construction to the correspondingly stepped portions in the embodiment of FIGS. 1–9. As before, the downwardly stepped portions 93 permit a user to insert one or more fingers between the lid and the container when a lid is assembled to a container to disassemble the container assembly.

The container rim 88 at the upper end of side wall 84 is especially contoured so as to cooperate with the lid to effect a double seal utilizing a mechanical locking action. The upper edge, indicated generally at 98, see FIG. 12, is rounded for the purpose of closely conforming to the bight 99, see FIG. 12, formed between the inner 78 and outer 79 lid flanges of the lid 71. However, the lower portion of the approximate inner half of the rounded upper edge 88 projects radially inwardly with respect to the interior surface 101 of the side wall 84, thereby creating, in effect, a slight internal bulge at the upper end of side wall 84. The upper end portion of the rim is thickened as contrasted to the thickness of wall 84 beneath the flange 89, and said upper end portion increases in thicknesses for a short distance downwardly from the upper edge, all as indicated at 102, said increase in thickness terminating in a shoulder 103 having a downwardly facing bearing surface 104, see FIG. 15.

Figure 13:
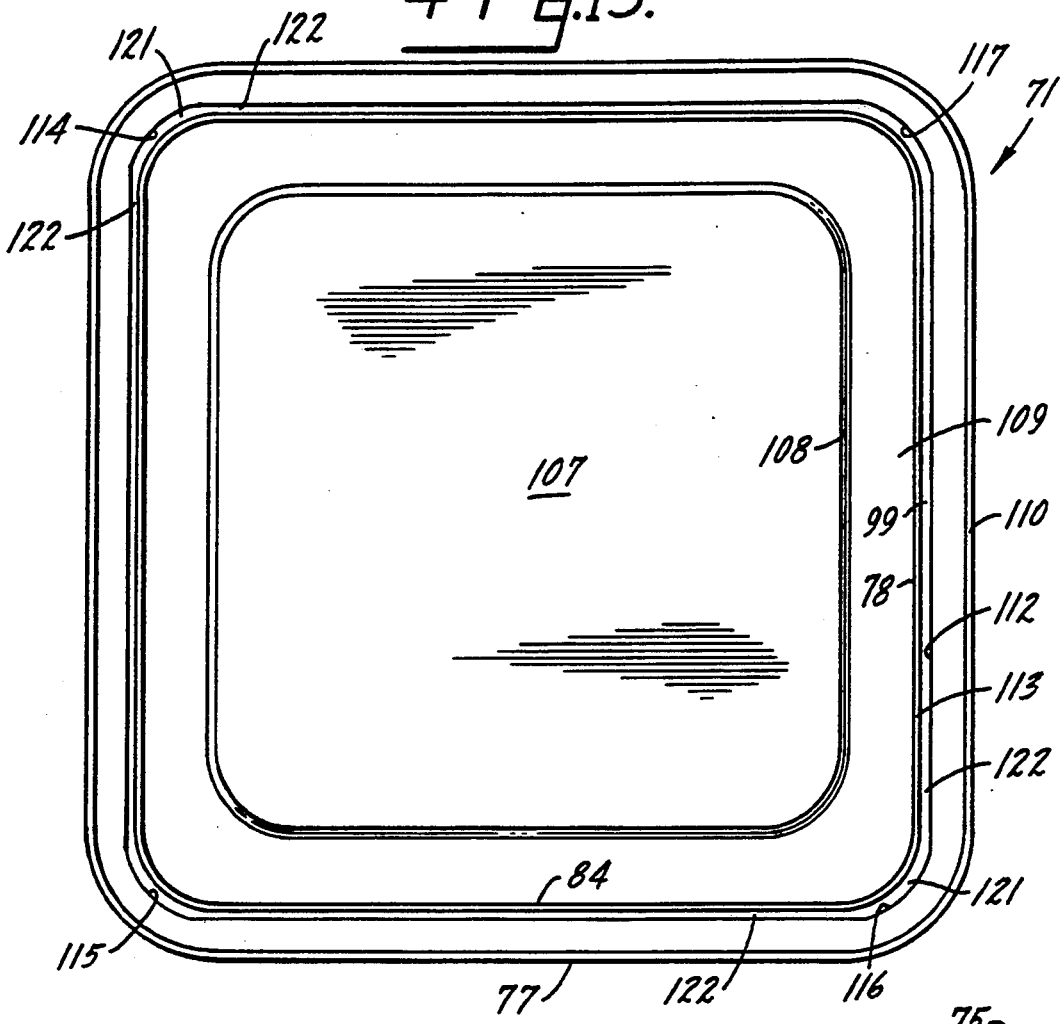
FIG. 13 is a plan view of the underside of the lid of the container assembly of FIG. 10.
Figure 14:
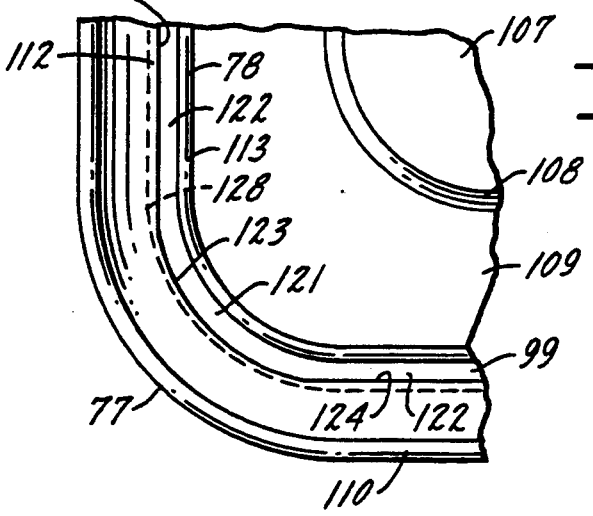
FIG. 14 is a plan view of a corner area of the underside of the lid to an enlarged scale as shown in FIG. 13.

Referring now to FIGS. 12, 13 and 15 particularly, the feature of generating an audible sound to signal proper assembly of the lid to the container is there shown.

In FIG. 13, the under surface of the central depression 73 is indicated at 107, the underside of lid rim 74 at 108, and the underside of crown 75 at 109. The bottom edge of lip 77 is indicated at 110. A snap ring 112 projects generally radially inwardly from the lower end of outer lid flange 79. The bottom edge of flange 78 is indicated at 113.

FIGS. 12 and 15 illustrate the assembly and sealing and locking features of the rectangular container assembly of the embodiment of FIGS. 10–15.

As the lid 71 is pushed downwardly onto container 72, the underside 118, see FIG. 12, of the snap ring 112 will initially contact the upper edge 98 of the rim and be thereafter cammed outwardly as the lid continuous its downward movement toward the container. Shortly before the lid reaches its seated and sealed position of FIGS. 12 and 15, the lower outer edge 126 of inner flange 78 will contact the inner surface of the rim 88. Since all contacting areas are smooth, the parts will cam with respect to one another until snap ring 112 passes beneath shoulder 103 and moves to the position of FIG. 15.

The task of disassembly of this type of container having defined sides (i.e.: 3 or more separately discernable surfaces), as contrasted to a circular configuration, raises special problems. This is believed to occur because when a force is applied at a corner area, such as for example at 93, which is directed to prying the lid 71 up and away from the defined side container 72, here a square container, it is believed that a tightening occurs at the transverse corners, here 119 and 120, see FIG. 10. Specifically, it is believed that an upward force exerted on lip 77 at corner 93 will have a tendency to force the snap ring 112 into tighter gripping engagement with the underside of shoulder 103 of the container rim in corners 119 and 120. Indeed, experience has established that, if all components are symmetrically configured at all locations, the lid will bind or grip the container beyond the point where the container assembly becomes convenient to use by the consumer.

To eliminate this significant problem the snap ring 112 is constructed as shown in FIGS. 12, 13 and 15. Referring to FIG. 13 initially, it will be seen that snap ring 112 has cut away areas 114,115, 116 and 117 at each corner to thereby provide a space 121 at each corner between the inner edge of snap ring 112 and the bottom edge of flange 113, which space 121 is wider than the space 122 on either side of the corner area. This difference in spacing is more clearly seen from a comparison of the components in FIGS. 12 and 15. In FIG. 12, which illustrates the spacing between the snap ring 112 and the outer edge 113 of inner flange 78 at a location between corners, the space 122 is quite small. In FIG. 15, which illustrates the spacing between the snap ring 112 and the outer edge 113 of inner flange 78 at a corner, the space 121 is substantially larger than space 122. This difference is also shown in the larger scale partial view of FIG. 11 wherein the inner edge portion 123 of snap ring 112 at a corner is displaced further outwardly toward the outside of the lid than those portions 124 of the inner edge of snap ring 112 on either side of a corner.

As a result, when the user lifts the lid at a location 93, the snap ring 112 in the corner areas 119, 120 will not move into tight, abutting engagement with the outer surface 125 of side wall 84, and only normal hand pressure is required to separate the lid from the container. Depending on molding variations, the innermost surface of snap ring 112 at the transverse corners 119, 120 may move only to about the position illustrated in FIG. 12. The outermost point of the inner surface of flange 79 about the snap ring 112 is indicated at 128 in FIGS. 14 and 15. A very small difference in spacing can also be appreciated from FIG. 11 which shows, at 123 and 124, a projection onto the container of the inner surfaces of the snap ring 112 at a corner, with 123 representing the cutaway, actual outline of the snap ring 112, and 124 representing the nominal outline of the snap ring 112 at the corner if the cutaway areas 114–117 were not present.

Figure 16:
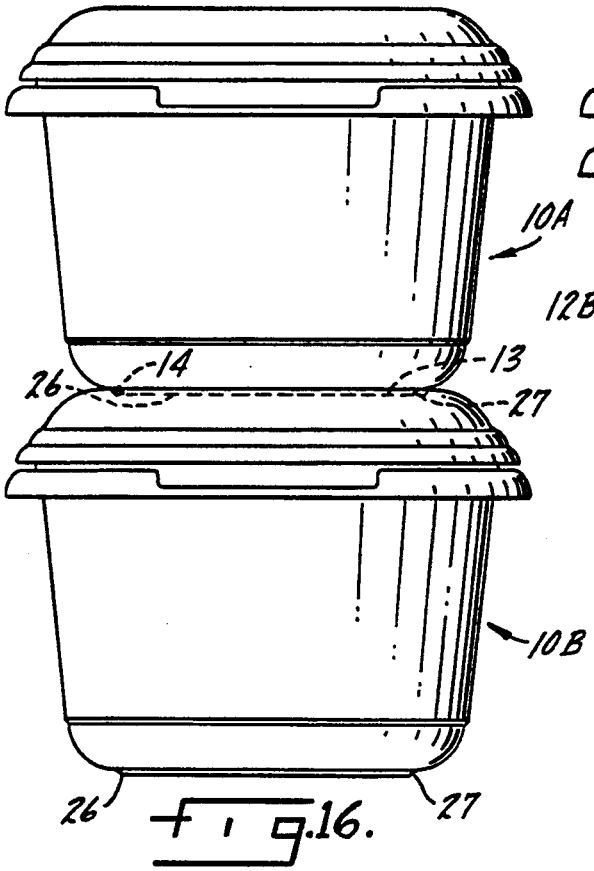
FIG. 16 is a side view, partly in phantom, of two equal size container assemblies stacked one upon the other.

The stacking feature of the container assemblies is illustrated in FIG. 16. In this Figure an upper container assembly 10A stacks in stable condition on lower container assembly 10B. The circular ridge 26 on the bottom of container assembly 10A nests in the central depression 13 of container assembly 10B, with outermost surface of ridge 26 bearing against the upwardly, outwardly included rim 14 of container assembly 10A.

Figure 17:
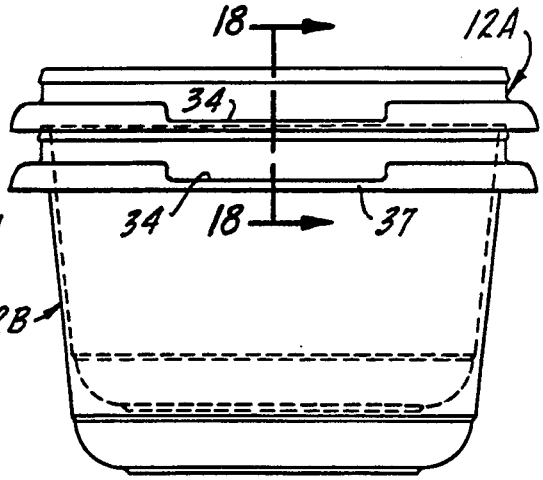
FIG. 17 is a side view, partly in phantom, of two equal size container assemblies nested one within the other.
Figure 18:
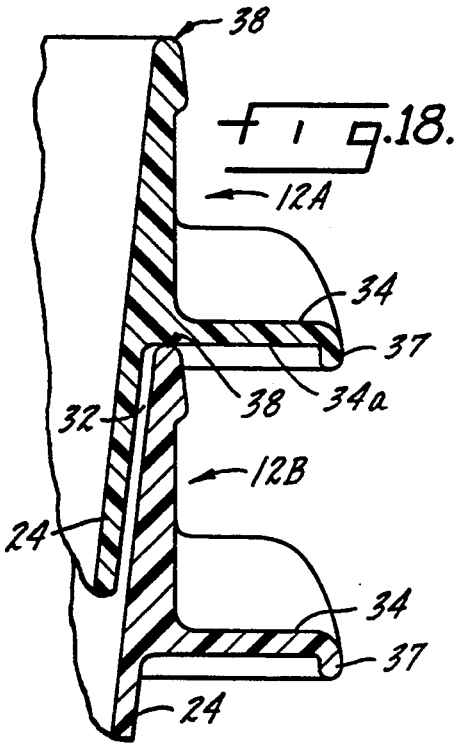
FIG. 18 is a partial view to an enlarged scale taken substantially along the line 18—18 of FIG. 17.

The nesting feature of the container assemblies is illustrated in FIGS. 17 and 18. Upper container 12A nests within lower container 12B so that a minimum of horizontal space is utilized. The nesting feature is attributable to the two or more base portions 34 of the two or more stepped portions 33 of each container interacting with the container rim 38 of the next lower container. From FIG. 18 it will be seen that the undersurface 37 of stepped portion 33 rests upon the container rim 38 of container 12B. It will be noted that a space 32 exists between the outer surface of wall 24 of upper container 12A and the inner surface of wall 24 of lower container 12B so that there is no possibility that the containers will seat snugly one within another and resist disassembly.

Figure 19:
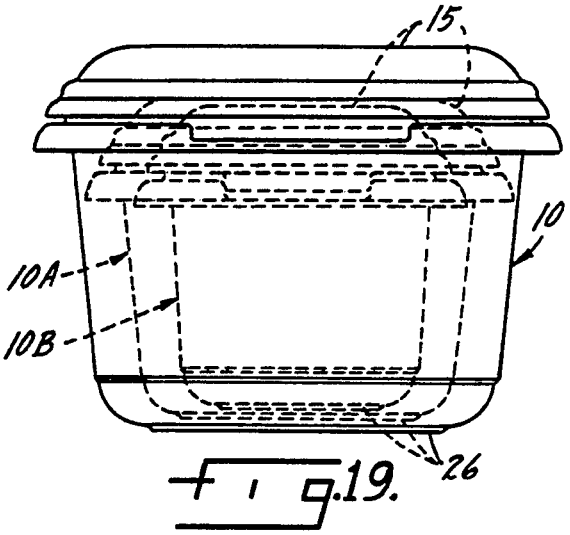
FIG. 19 is a side view, partly in phantom, of a set of container assemblies including lids nested one within the other.

Nesting of complete container assemblies, that is lids assembled to containers, is illustrated in FIG. 19. In this Figure a small container assembly 10B is received within a slightly larger container assembly 10A, and container assembly 10A is in turn received within a slightly larger container assembly 10. In each instance, the vertical distance between the bottom of circular ridge 26 and the top of crown 15 on an inner container assembly is less than the vertical distance between the top of bottom wall 25 and the undersurface 47 of the central depression 13 of an outer container assembly.

Figure 20:
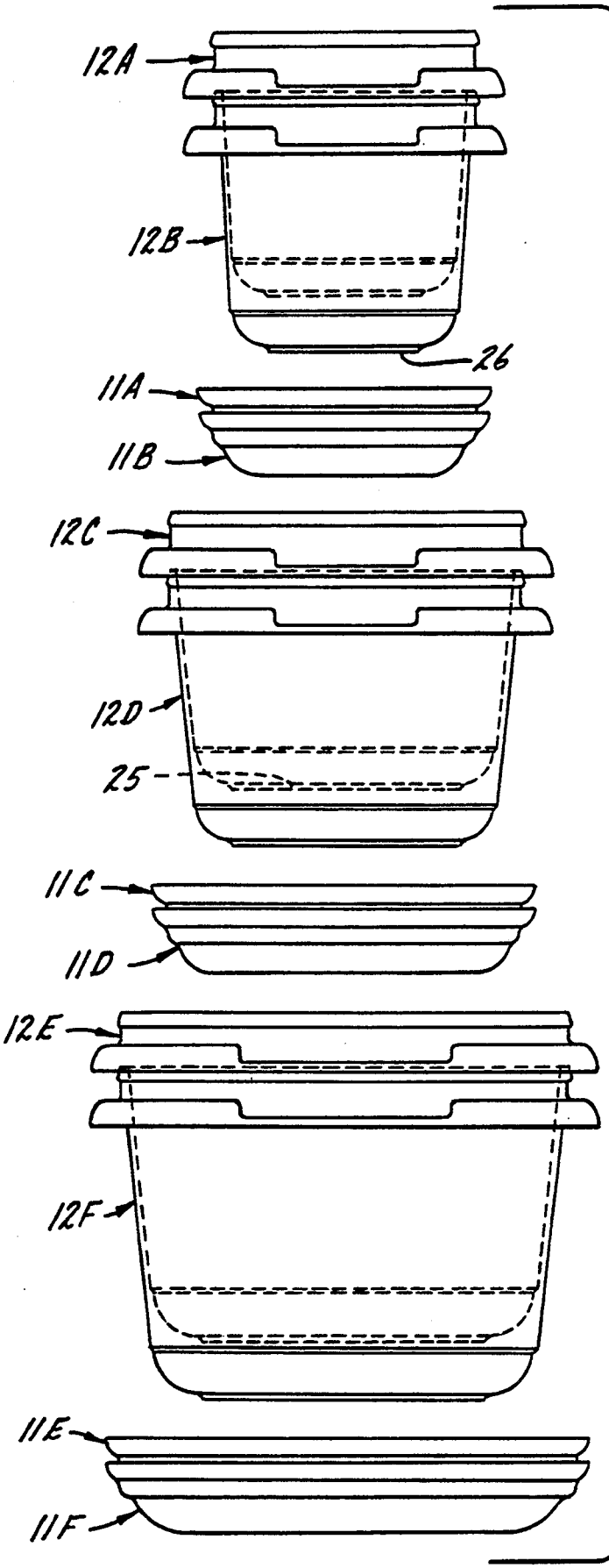
FIG. 20 is an exploded side view, with parts in phantom, of a plurality, here two, sets of container assemblies, including lids, nested one within the other.
Figure 21:
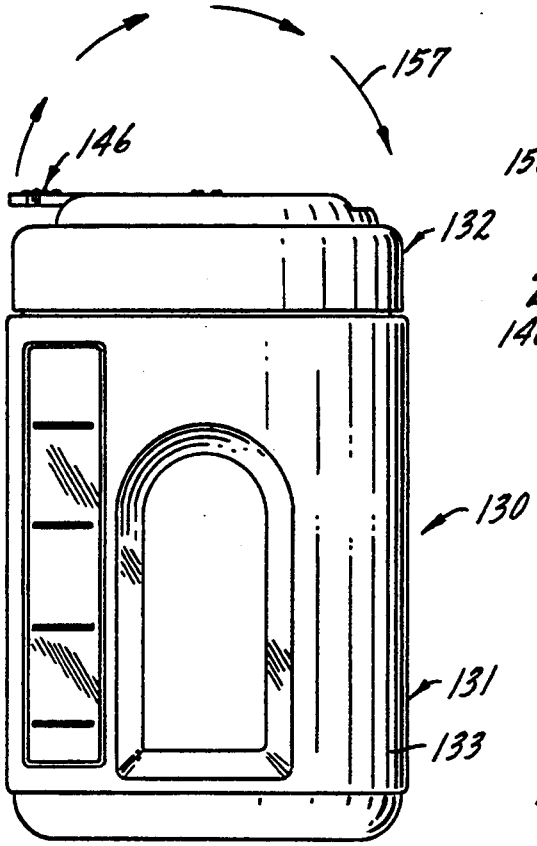
FIG. 21 is a side view of a dispensing container assembly.
Figure 22:
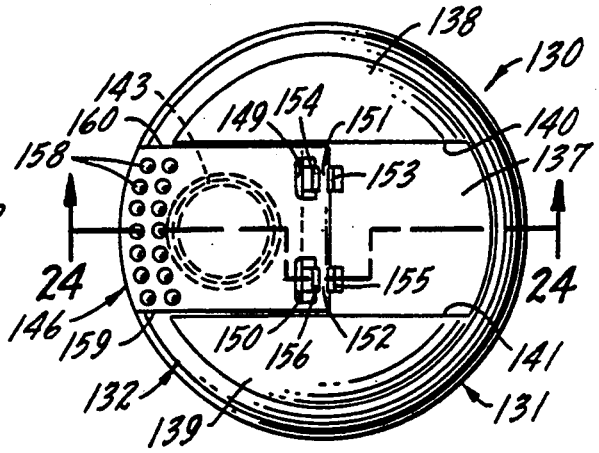
FIG. 22 is a top plan view of the container assembly of FIG. 21.

FIG. 20 illustrates the nesting of a plurality of same size container assemblies within a plurality of same size, but larger, container are assemblies, including lids. Two containers 12A, 12B are nested within one another as described in connection with FIGS. 17 and 18. The bottom container 12B in turn sits upon two lids 11A, 11B since the diameter of circular ridge 26 on the bottom of container 12B is smaller than the diameter of the undersurface 47, not shown, of lid 11A. In similar fashion, lids 11A and 11B, and their associated containers 12A and 12B, seat on the upper surface of bottom wall 25 of container 12C in the pair 12C and 12D. Containers 12C and 12D in turn seat in a stable condition on the undersurface 47, not shown, of lid 11C in the pair 11C and 11D, all the above described lids and containers are, in turn, received in the containers 12E and 12F which rest on lid 11E in lid set 11E and 11F. It will be noted that there is no theoretical limit to the number of sets of two or more lids and/or containers which may be nested in this way.

A dispensing container assembly in which a dispensing closure may be swung to, and positively retained in, a 180° open position is illustrated in FIGS. 21–24.

The dispensing container assembly is indicated generally at 130, the assembly including a container indicated generally at 131 and a lid indicated generally at 132. The container includes an expanded central portion 133 which terminates at its upper end in a neck portion 134 having means for receiving and retaining the lid, such as screw threads 135.

The lid 132 includes a base 137 having chordial elevated side sections 138 and 139. Each side section 138,139 has an inner wall 140, 141 which preferably lie parallel to one another, though they need not be parallel. A spout is indicated at 143, the spout, in this instance projecting upwardly from a portion 144 of the base which is at a lower elevation than base wall 137.

Figure 24:
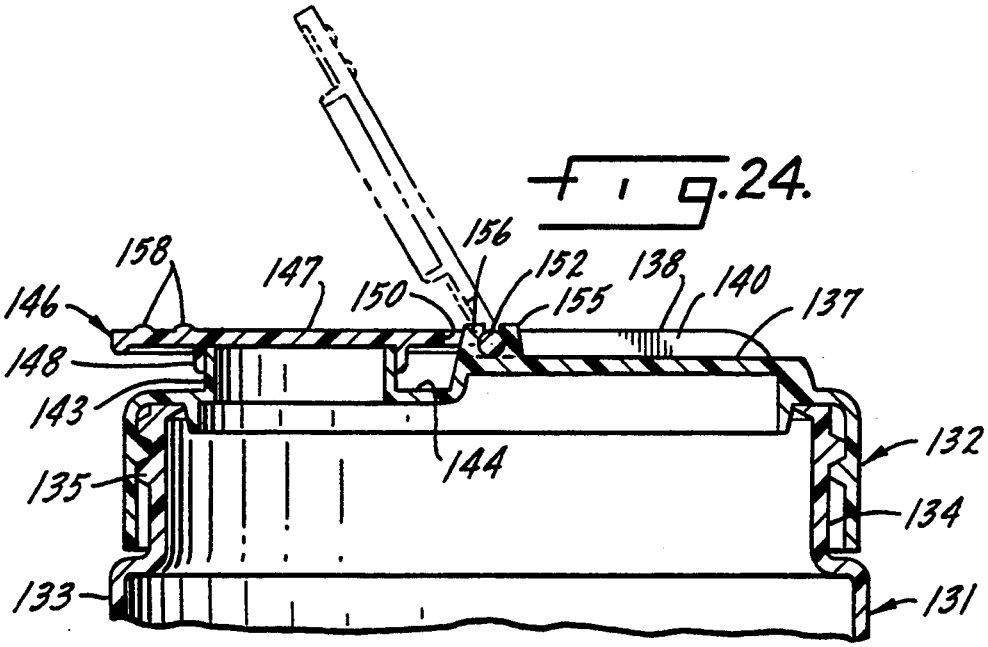
FIG. 24 is a partial section view taken substantially along the line 24—24 of FIG. 22.

A dispensing closure is indicated generally at 146, the closure including a base 147 from which a ring 148 projects downwardly from the underside, ring 148 being contoured to snugly fit over the exterior periphery of spout 143. A pair of cut-outs are indicated at 149, 150 near the inner end of base 147 to form, in effect, a pair of pivot pins 151, 152 at the inner end of the base 147. A pair of prongs which extend upwardly from lid base 137 are indicated at 153, 154, and a second pair at 155, 156. First pair 153, 154 are spaced a distance apart sufficient to receive, and snugly retain pivot pin 151, and the second pair 155, 156 are similarly spaced a distance apart sufficient to receive, and snugly retain, pivot pin 152. Since the material of which the lid components are made is a flexible plastic, such as polypropylene, it will be appreciated that the pivot pins and the holding prongs can be manufactured so as to provide a snug fit, and yet enable the closure 146 be freely swingable along the arc indicated by arrow 156 in FIG. 21 of which an intermediate position is shown in FIG. 24. A plurality of humps are indicated at 158 for a propose which will appear hereinafter.

Figure 23:
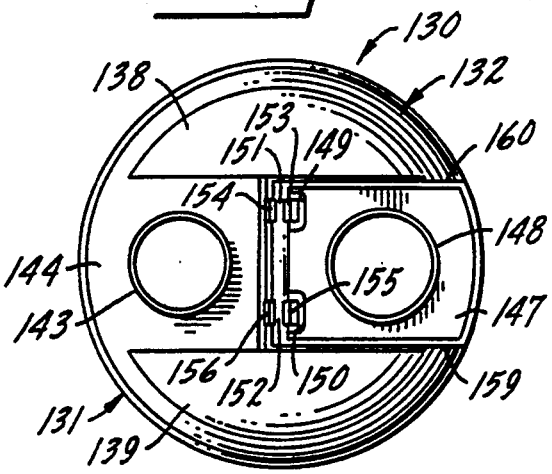
FIG. 23 is a top plan view of the container assembly of FIG. 21 with the dispensing lid in an open position.

FIG. 23 illustrates the closure 146 in a fully open position. In this position the sides 159, 160 of closure 146 are received with a light snug fit in the spaces between inner walls 140, 141 of the lid chordial sections 138, 139; in other words, the closure 146 is very lightly wedged between the walls 138, 139 with a force sufficient to prevent the closure from flopping forwardly unexpectedly when the container assembly is tilted forward during pouring out of its contents. Since the contents will frequently be liquids having sticky or adhering properties, such as fruit juices, it is desirable that the flat upper surface of closure 146 not make abutting contact with the flat surface of lid base 137. The humps 158 effectively preclude such adhesion of the closure to the lid base even after a prolonged period of exposure to the drying effect of the atmosphere. At the same time, a neat, trim line appearance is presented as can be appreciated from the flat appearance of the lid in FIGS. 21 and 24. By locating the pivot axis of pivot pins 151, 152 slightly to the front of the central diameter of the lid, a lift tab is provided when the closure is in the closed condition of FIG. 21, and yet the closure is contained within the outline of the lid when the closure is in the open position of FIG. 23.

Accordingly, although a specific embodiment of the invention has been illustrated and described, it will be at once apparent to those skilled in the art that modifications may be made within the spirit and scope of the invention. Accordingly, it is intended that the scope of the invention be limited solely by the scope of the hereafter appended claims when interpreted in light of the relevant prior art, and not by the foregoing exemplary description.

We claim:

1. A container assembly, said container assembly including a container, a lid adapted to be assembled to and disassembled from the container.

said lid having downwardly depending inner flange means and outer flange means, said flange means defining a seat therebetween at the upper portion of a downwardly open space adapted to receive a container rim, said lid further including resilient hinge means formed integrally with the lid and located between the flange means whereby said flange means may flex toward and away from one another, first mechanical locking means carried by the lower end portion of the outer flange means and adapted to engage the container, said container having second mechanical locking means carried by the upper portion of the container and adapted, when the lid is fully assembled to the container, to engage the first mechanical locking means, said mechanical locking means, when engaged, forcing the upper edge of the container into seating engagement in the seat formed between the inner and outer lid flange means, the force causing the mechanical locking means to urge the upper edge of the container into seating engagement in the seat formed between the inner and outer flange means is derived from the flexing of the material in the hinge means.

2. The container assembly of claim 1 further characterized firstly, in that the first locking means comprises projection means at the lower portion of the outer flange means which project inwardly toward the outer wall of the container, and secondly, in that the second locking means comprises projection means on the outer wall of the container which project outwardly toward the outer flange means, said second locking means overlying the first locking means, said hinge means causing said first locking means to bear against the second locking means.

3. The container assembly of claim 2 further characterized in that the lid includes lifting means extending outwardly from the outer flange means, said lifting means extending sufficiently far outwardly to enable a user to simultaneously disengage the mechanical locking means and lift the lid from the container.

4. The container assembly of claim 3 further characterized in that the container includes lifting means extending outwardly from the upper portion of the container, said container lifting means being located closely beneath the lid lifting means when the lid is assembled to the container and, access means between the lid lifting means and the container lifting means for enabling a user to insert a plurality of finger tips therebetween prior to lifting the lid from the container.

5. The container assembly of claim 2 further characterized firstly, in that the outer flange means is continuous about the periphery of the lid, secondly, in that the first locking means is a ring formed integrally with the lower portion of the outer flange means and extending around the entire periphery of the outer flange means, thirdly, in that the upper portion of the container commencing at the upper edge and extending downwardly therefrom increases in thickness in a downward direction to a maximum thickness near the lower end portion of the outer flange, and fourthly, in that the material of which the lid is formed is sufficiently flexible to permit the ring to be displaced outwardly from its normal unstressed position and then to snap into locking engagement with an audible sound when the snap ring clears the maximum thickness of the upper portion of the container.

6. The container assembly of claim 5 further including alignment means for positioning the lid at the proper assembly angle with respect to the container prior to flexing of the lid as it is assembled to the container, and for guiding the lid as it makes contact with the container during assembly.

7. The container assembly of claim 6 further characterized in that the alignment means comprises a plurality of cams located about the periphery of the snap ring and extending downwardly therefrom, said cams being oriented so as to simultaneously contact the upper edge of the container prior to assembly.

8. The container assembly of claim 7 further characterized in that the cams extend downwardly to the snap ring, the lower portion of said cams at the level of the snap ring extending radially inwardly slightly further than the inner most edge of the snap ring.

9. The container assembly of claim 1 further characterized in that the container includes nesting means extending outwardly from the periphery of the container whereby a container may be nested within a like sized container.

10. The container assembly of claim 1 further characterized in that the lid includes a central depression in its upper surface, and the container includes a downwardly extending ridge on its bottom surface, the peripheral contours of the central depression and the ridge being similar except the ridge is slightly smaller in contour that the central depression whereby the container in one container assembly may be stably stacked on a lid in an underlying container assembly.

11. The container assembly of claim 1 further characterized in that the ridge on the bottom of a container rests in flat, abutting contact on the under surface of a complimentary lid.

12. The container assembly of claim 1 further characterized in that the lid and container are round.

13. The container assembly of claim 5 further characterized in that the lid and container are rectangular.

14. The container assembly of claim 13 further characterized in that the inward projection of the snap ring is less at the corners of the rectangle than on the sides flanking the corners.

15. The container assembly of claim 14 further characterized in that the access means for enabling a user to insert a plurality of fingertips between the lid lifting means and the container lifting means are located at least two diagonally opposed corners.

16. A container assembly, said container assembly including a container, a lid adapted to be assembled to and disassembled from the container, said lid having downwardly depending inner flange means and outer flange means, said flange means defining a seat therebetween at the upper portion of a downwardly open space adapted to receive a container rim, said lid further including resilient hinge means formed integrally with the lid located between the flange means and having a lesser thickness than those portions of the flange means which flank said lesser thickness, whereby the flexing action of said hinge means is unhindered and said flange means may flex toward and away from one another, first mechanical locking means carried by the lower end portion of the outer flange means and adapted to engage the container, said container having second mechanical locking means carried by the upper portion of the container and adapted, when the lid is fully assembled to the container, to engage the first mechanical locking means, said mechanical locking means, when engaged, forcing the upper edge of the container into seating engagement in the seat formed between the inner and outer lid flange means, the force causing the mechanical locking means to urge the upper edge of the container into seating engagement in the seat formed between the inner and outer flange means being derived from the flexing of the material in the hinge means.

17. The container assembly of claim 16 further characterized in that said lid has a central recessed portion in its upper surface of a width which receives within it the base of a similar sized container assembly so as to enable two such similar sized containers to be stacked one upon the other in a stable relationship in which sideways displacement of the uppermost container assembly is precluded by the edge of the recessed portion in the lid of the lowermost container.

* * * * *